United States Patent [19]

Lilley

[11] Patent Number: 4,584,096

[45] Date of Patent: Apr. 22, 1986

[54] PROCESS TO BENEFICIATE PHOSPHATE AND SAND PRODUCTS FROM DEBRIS AND PHOSPHATE TAILING ORES

[75] Inventor: George M. Lilley, Lakeland, Fla.

[73] Assignee: J. Warren Allen, Lithia, Fla.

[21] Appl. No.: 347,693

[22] Filed: Feb. 11, 1982

[51] Int. Cl.[4] ..... B03D 1/14

[52] U.S. Cl. ..... 209/166; 209/167; 299/7; 210/705

[58] Field of Search ..... 209/166, 167, 3, 10; 299/7, 9; 405/128, 258; 210/907, 705, 710, 747

[56] References Cited

U.S. PATENT DOCUMENTS

| | | | |
|---|---|---|---|
| 2,553,905 | 5/1951 | Evans | 209/12 |
| 2,868,618 | 1/1959 | Oberg et al. | 209/3 |
| 2,914,173 | 11/1959 | Le Baron | 209/166 |
| 3,259,326 | 7/1966 | Duke et al. | 209/3 |
| 3,314,537 | 4/1967 | Greene et al. | 209/166 |
| 3,388,793 | 6/1968 | Dibble | 209/3 |
| 4,298,229 | 11/1981 | D'Alli | 299/7 |

*Primary Examiner*—Bernard Nozick

*Attorney, Agent, or Firm*—Frijouf, Rust & Pyle

[57] ABSTRACT

The method of beneficiating phosphate tailings and debris waste material is disclosed for producing enriched phosphate ore and a sand product which is usable for glass, cement and the like or for land reclamation. The method includes treating the phosphate tailings and waste material with a cationic reagent and subjecting the tailings and waste material to a flotation process to overflow the sand product therefrom. The underflow phosphate ore is subjected to a conventional double flotation process to produce a high grade phosphate product. The sand product may either be directly pumped into an existing phosphate quarry for land reclamation or may be deregentized and treated with anionic reagents to remove remaining impurities providing a sand product suitable for glass, cement and the like.

4 Claims, 1 Drawing Figure

PROCESS TO BENEFICIATE PHOSPHATE AND SAND PRODUCTS FROM DEBRIS AND PHOSPHATE TAILING ORES

BACKGROUND OF THE INVENTION

1. Field of the Invention

This invention relates to phosphate processes and more particularly to the production of high grade phosphate products from phosphate tailings and debris waste material and the production of a sand product for land reclamation or for use in glass, cement and the like.

2. Description of the Prior Art

Various types of methods have been devised by the prior art for processing raw phosphate ore into phosphate by-products including phosphoric acid, superphosphoric acid, feritilizers and the like. The various processes have been adapted in accordance with the type of phosphate ore present in various parts of the world and in accordance with the amount of phosphate contained in the ore matrix. Different grade matrix ores required different processes for extracting the phosphate from the ore in the most economical way.

The double float process is commercially used for the beneficiation of phosphate ore when the phosphate ore matrix contains impurities such as silicate materials. In this process the beneficiation of phosphate ore begins by digging the ore matrix from the ground. The ore matrix is used to form a slurry with water and is then pumped to a beneficiation plant. The coarse phosphate rock is screened out on a screen size generally ranging from +14 to +20 mesh. Material passing through the screen is the +20 mesh deslimed at 150 mesh. The material passing 150 mesh is called "slimes" and contains mostly clay, silica and phosphate. The slime is typically discarded in the conventional double float process. The usable ore typicaly −20 to +150 mesh is passed through a first flotation process for extracting the phosphate from the deslimed matrix. The usable ore is treated with a fatty acid fuel-oil (an anionic agent) conditioned in an alkali solution which causes the desired phosphate ore to float upon an underfloat. The underfloat, generally called "rougher tailings" is discarded in the conventional float process. The desired phosphate ore or overfloat, typically called "rougher concentrate" is deoiled with sulphuric acid to remove the anionic reagent and is then washed with water. Thereafter the washed overfloat is treated with an amine and kerosene (cationic reagent) in a second flotation process. The second flotation process removes silica whch floated during the first flotation process to produce a final concentrate grade of 70–76 percent BPL (bonded phosphate of lime) which is the desired product from the flotation process. The froth product tailings which are separated in the second flotation process from the final concentrate grade of phosphate is discarded under most prior art flotation processes. This froth product tailing contains from 8–25 percent BPL, but have been considered waste and discarded since there has not been an efficient and inexpensive method of extracting the 8–25 percent BPL from the froth product tailing.

Arthur Crago disclosed in U.S. Pat. No. 2,293,640 a method of concentrating phosphate materials from ore which comprises, in the first step, subjecting the ore to an aqueous pulp to a concentrating operation with negative ion reagents to separate a rougher concentrate of the phosphate values admixed with entrained silicious gangue. The second step of the Crago process involved treating the rougher phosphate concentrate with a mineral acid to remove the effect on both the phosphate and the silica particles of the negative ion reagent used in the production of the rougher concentrate. The third step of the Crago process included subjecting the acid-treated rougher concentrate in an aqueous pulp to a concentrating operation with a positive ion reagent which is a selective collector for the gangue in the rougher phosphate concentrate to separate out the material largely composed of silicious gangue thereby producing the final phosphate concentrate.

A further improvement of the Cargo process was disclosed by James D. Duke et al in U.S. Pat. No. 2,753,996. Duke et al improved upon the Crago method since Duke recognized the loss of phosphate in the silicious froth product since in practice it is impossible to produce a pure silica float. In the concentration of phosphate material by flotation employing only negative ion reagents, the middling product from the cleansing operation is often returned and passed through the system again with a new feed. However, the silicious froth product cannot be treated as a middling in that way. In attempting to following such a procedure in practicing the Crago method, a considerable amount of silica floats with the rougher concentrate thus lowering the grade of the finished phosphate concentrate. In addition, some of the phosphate does not float, thus causing a loss of phosphate in the tailings and the accumulation of phosphate in the middling which is returned to the original feed. In the practice of the Crago method, the silicious froth product containing a large amount of the silica removed from the rougher flotation product was discarded and a considerable amount of phosphate must be discarded.

The rougher tailings and froth product is usually stored in large waste areas since it is considered too low grade to economically reclaim the phosphate. In addition, this material is radioactive which prohibits the use of this material for filling the large phosphate quarries. Many acres of land cannot be economically reclamated due to the radioactive waste piles and the phosphate quarries.

Therefore, it is an object of this invention is to provide a method of beneficating phosphate tailings and debris waste material to produce a sand suitable for use in glass, cement or the like.

Another object of this invention is to provide a method of beneficating phosphate tailings and debris waste material to reclaim heavy minerals contained in the waste debris.

Another object of this invention is to provide a method of beneficating phosphate tailings and debris waste material to produce sand and heavy minerals with satisfactory radiation levels to enable land reclamation by filling phosphate quarries with radiation reduced waste products.

The foregoing has outlined some of the more pertinent objects of the invention. These objects should be construed to be merely illustrative of some of the more prominent features and applications of the invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with specific embodiment shown in the attached drawings. For the purpose of summarizing the invention, the invention may be incorporated into a method of beneficiating phosphate tailings and debris waste material to produce enriched phosphate ore comprising the steps of treating the material with a cationic reagent and floating the waste material and debris with the cationic agent on the phosphate tailings to overflow the sand product in the waste material. The process includes treating the underflow phosphate tailings with a double flotation process to produce a high grade phosphate product.

In a more specific embodiment of the invention, the overflow sand product may be directly pumped into an existing quarry to provide land reclamation of existing phosphate quarries. The removal of the phosphate tailings from the sand product reduces the radioactivity of the sand directed into the existing quarry making the land suitable for use. In the alternative, the sand product may be dereagentized and treated with anionic reagents to remove remaining impurities to provide a high quality sand product for glass, cement and the like. The remaining impurities may be likewise subjected to a process for separating usable materials from the impurities removed from the sand product.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, referece should be had to the following detailed description taken in connection with the accompanying drawings in which:

The FIGURE illustrates a flow diagram of the present invention with alternative processes which may be incorporated within the invention.

DETAILED DESCRIPTION

Figure 1:
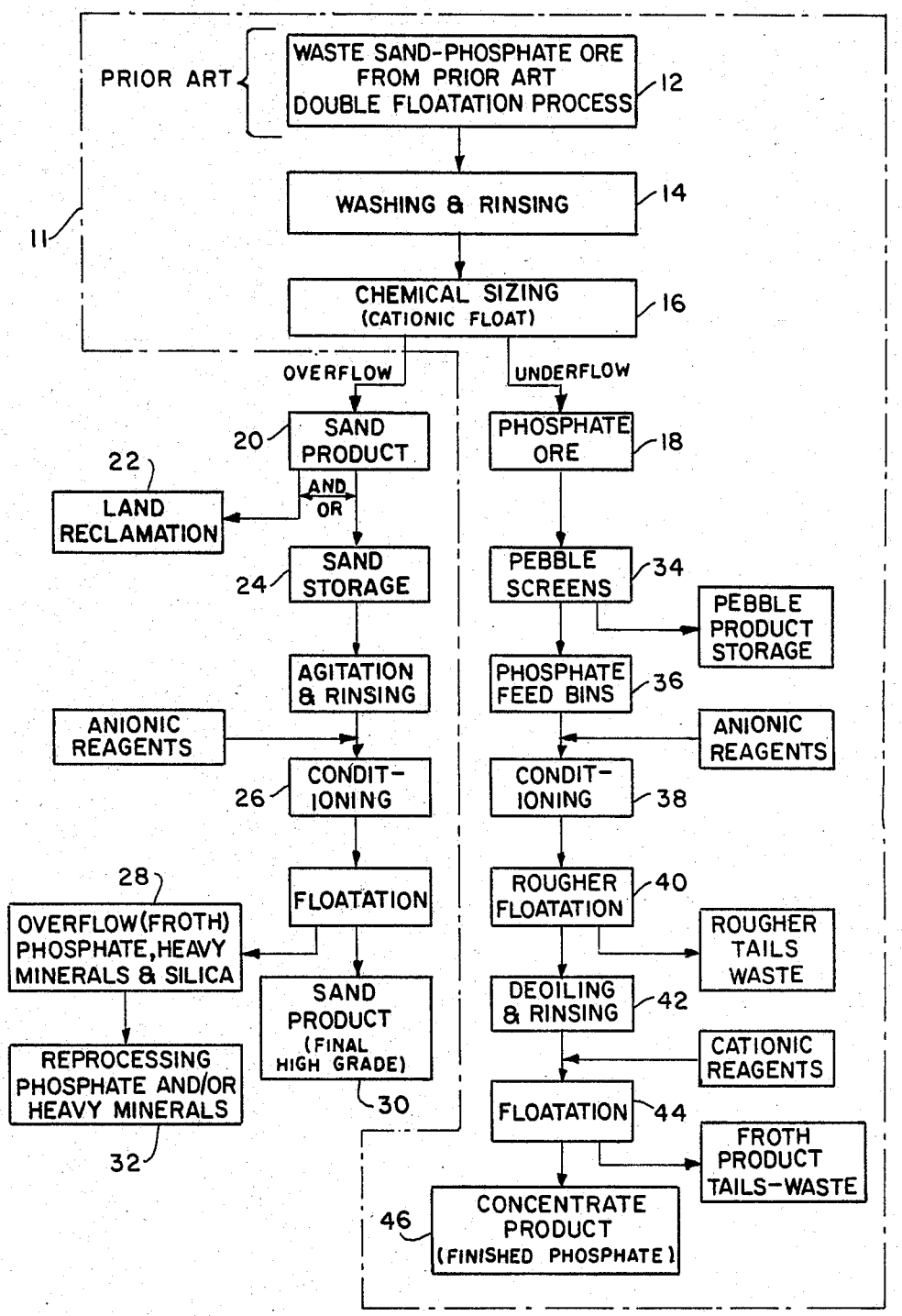

The invention shown by the flow diagram of the FIGURE discloses a process to reclaim the millions of tons of phosphate rock and sand products that are now stored in old phosphate tailing wastes. The tailing waste products typically do not have a phosphate content for justifying the cost of reprocessing the tailing piles. Since the tailing piles are radioactive due to the phosphate content therein, the tailing piles cannot merely be used to fill the phosphate quarries which exist in proximity to the phosphate tailing waste piles. Accordingly, hundreds of acres of land are unusable due to quarries and radioactive tailing piles.

The FIGURE illustrates a flow diagram of a process for the beneficiation of phosphate ore and the production of marketable other products and/or land reclamation with the prior art process being enclosed in block 11. The sand phosphate ore 12 typically includes low grade phosphate tailings which generally range from 8 percent BPL to 12 percent BPL in addition to large amounts of sand and other heavy minerals. The phosphate ore 12 is passed through a washing stage 14 and is chemically sized in a cationic floatation process 16 using a cationic reagent for separating the sand and other heavy minerals from the phosphate ore. The sand-phosphate tailing ore typically has a particle size of −20 to +150 mesh. Because of the size and weight of the larger sand particles, the larger sand particles will not float which produces a fine clean sand product with a particle size of approximately minus 35 to plus 150 mesh in the overfloat. The cationic reagent is a sand collector and therefore will reject most of the phosphate into an underflow product 18. The overflow product 20 consisting mostly of the sand product and heavy minerals may be pumped directly to land reclamation 22 and/or to a sand storage 24. The overflow product 20 has a low radiation level due to the removal of the phosphate ore.

If desired, the sand may be passed to an anionic conditioning stage 26 to treat the sand with an anionic reagent to overflow heavy minerals 28 and underflow finished sand products 30 which may be suitable for sand products such as glass and high grade cement sand and the like. If desired, the heavy minerals may be subjected to a subsequent separation stage 32 to separate the heavy minerals such as zircon, rutile and ilmenite.

The underflow 18 which contains most of the phosphae ore, typically enhanced from (8%–12%) BPL to (18%–30%) BPL, is passed through a pebble screen 34 to a phosphate feed bin 36. The enhanced feed is passed through a conventional double flotation process comprising anionic conditioning 38, rough flotation 40, deoiling and rinsing 42 and cationic flotation 44. The low-grade phosphate tails enhances the recovery of the finished phosphate concentrate 46 in addition to providing sand for land reclamation 22 and/or finished sand product 30 in addition to other heavy materials. The following examples indicate results of the disclosed invention:

A phosphate tailing sample (−20+150 mesh) with a grade of 14% BPL was treated with cationic reagents and run through the chemical sizing float. Following are the results:

| Product | % Wt. | % BPL | % BPL Dist. |
|---|---|---|---|
| Overflow (sand) product | 56.6 | 1.74 | 6.9 |
| Underflow (upgraded ore) product | 43.4 | 30.56 | 93.1 |
| Composite Head | 100.0 | 14.24 | 100.0 |

EXAMPLE II

The sand product (−35+150 mesh) was dereagentized and treated with anionic reagents to remove the remaining phosphate and minerals. Following are the results:

| Product | % Wt. | % BPL | | % BPL Dist. |
|---|---|---|---|---|
| Sand tails | 5.3 | 32.15 | | 97.9 |
| Sand product | 94.7 | 0.05 | (trace) | 2.1 |

-continued

| Product | % Wt. | % BPL | % BPL Dist. |
|---|---|---|---|
| Composite Head | 100.0 | 1.74 | 100.0 |

EXAMPLE III

Upgraded phosphate ore was treated with the standard double float process. Following are the results:

| Product | % Wt. | % BPL | % Insol. | % BPL Dist. |
|---|---|---|---|---|
| Rougher tails | 56.2 | 2.29 | — | 4.2 |
| Froth tails | 4.8 | 20.45 | — | 3.2 |
| Final concentrate | 39.0 | 72.55 | 3.44 | 92.6 |
| Composite Head | 100.0 | 30.56 | | 100.0 |

EXAMPLE IV

Following is a table showing the complete products and grade summary:

| Product | % Wt. | % BPL | % Insol. | % BPL Dist. |
|---|---|---|---|---|
| Head sample | 100.0 | 14.24 | — | 100.0 |
| Final Phos. Conc. | 16.9 | 72.55 | 3.44 | 86.3 |
| Phosphate tails | 25.6 | 3.72 | — | 6.9 |
| Sand tails | 3.0 | 32.15 | — | 6.8 |
| Sand product | 53.6 | Trace | — | — |
| | 100.0 | 14.21 | | 100.0 |

Although various reagents may be used with the process, the conventional reagents used in the conventional flotation processes have been found to operate satisfactorily with the present invention. The cationic reagent may include a caustic soda and ammonia for use as an alkali solution. The anionic fatty acid reagent is generally a blend from tall oil, vegetable oil, animal products or a combination thereof. These products typically include additives such as 5%–20% rosin, 100%–150% acid number and 15%–35% unsaponifables. The fuel oils typically comprise low grade petroleum products which are used to make fatty acid products more fluid. Sulphuric acid is typically used in the deoiling stage to wash the reagent from the product.

The cationic reagents include condensate amines, tallow amines or ether amines. The condensating amines are produced from the reaction of fatty acid with poly, delta, teta or tepa amines. Tallow amines are typically produced from reactions of talow fatty acids with ammonia and hydrogenated to obtain the desired amines. The ether amines are typically produced by reactions from alcohols and ammonia and hydrogenated to obtain the desired amines. Each of these cationic reagents may be free base or neutralized.

The aforementioned are some of the basic reagents used in the beneficiation of phosphate and sand products. Many reagent companies blend many different formulations of each or a combination of all of the above for different and specific applications. However, the foregoing process has been found to be suitable for use with the conventional reagents used in the flotation plants for the ore from phosphate deposits in the State of Florida.

The present disclosure includes that contained in the appended claims as well as that of the foregoing description. Although this invention has been described in its peferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. The method of beneficiating phosphate tailings containing sand, phosphate and other materials to produce phosphate, the phosphate tailings being formed by treating ore containing phosphate, sand and other materials by a double flotation process wherein the ore is firstly treated with an anionic reagent from producing a first overfloat containing enriched phosphate and for producing a first underfloat in the form of rougher tailings containing sand, some phosphate and other materials; secondly treating the first overfloat with a cationic reagent for producing a second underfloat containing predominantly phosphate and for producing a second overfloat in the form of froth product tailings containing sand, some phosphate and other materials, the improvement comprising:

treating the tailings with a cationic reagent and water for producing a third overfloat containing predominantly sand and other materials and for producing a third underfloat containing phosphate; and treating the third underfloat containing the phosphate in a subsequent double flotation process including fourthly treating the third underfloat with an anionic reagent to produce a fourth overfloat and fifthly treating the fourth overfloat with a cationic reagent to produce a fifth underfloat containing a high grade phosphate.

2. The method of beneficiating phosphate tailings containing sand, phosphate and other materials to produce high quality sand for glass and the like, the phosphate tailings being formed by treating ore containing phosphate, said and other materials by a double flotation process wherein the ore is firstly treated with an anionic reagent for producing a first overfloat containing enriched phosphate and for producing a first underfloat in the form of rougher tailings containing sand, some phosphate and other materials, secondly treating the first overfloat with a cationic reagent for producing a second underfloat containing predominantly phosphate and for producing a second overfloat in the form of froth product tailings containing sand, some phosphate and other materials, the improvement comprising:

treating the tailings with a cationic reagent and water for producing a third overfloat containing sand and other materials and for producing a third underfloat containing phosphate; and treating the third overfloat with an anionic reagent and water for producing a froth underfloat containing high quality sand for glass and other materials and for producing a fourth overfloat containing phosphate.

3. The method of beneficiating phosphate tailings containing sand, phosphate and other materials to produce sand and phosphate, the phosphate tailings being formed by treating ore containing phosphate, sand and other materials by a double flotation process wherein the ore is firstly treated with an anionic reagent for producing a first overfloat containing enriched phosphate and for producing a first underfloat in the form of rougher tailings containing sand, some phosphate and other materials; secondly treating the first overfloat with a cationic reagent for producing a second underfloat containing phosphate and for producing a second overfloat in the form of froth product tailings containing sand, some phosphate and other materials, the improvement comprising:

treating the tailings with a cationic reagent and water for producing a third overfloat containing predominantly sand and other materials and for producing a third underfloat containing phosphate; and treating the third underfloat containing the phosphate in a subsequent double flotation process including fourthly treating the third underfloat with an anionic reagent to produce a fourth overfloat and fifthly treating the fourth overfloat with a cationic reagent to produce a fifth underfloat containing a high grade phosphate.

4. The method of beneficiating phosphate tailings containing sand, phosphate and other materials to produce phosphate and the reclamation of land, the phosphate tailings being formed by treating ore containing phosphate, sand and other materials by a double flotation process wherein the ore is firstly treated with an anionic reagent for producing a first overfloat containing enriched phosphate and for producing a first underfloat in the form of rougher tailings containing sand, some phosphate and other materials; secondly treating the first overfloat with a cationic reagent for producing a second underfloat containing predominantly phosphate and for producing a second overfloat in the form of froth product tailings containing sand, some phosphate and other materials, the improvement comprising:

treating the tailings with a cationic reagent and water for producing a third overfloat containing predominantly sand and other materials and for producing a third underfloat containing phosphate;

filling existing landfill areas with the third overfloat; and treating the third underfloat containing the phosphate in a subsequent double flotation process including fourthly treating the third overfloat with an anionic reagent to produce a fourth overfloat and water and fifthly treating the fourth overfloat with a cationic reagent and water to produce a fifth underfloat containing high grade phosphate.

* * * * *